United States Patent [19]

Bigelow, Jr. et al.

[11] 4,327,529

[45] May 4, 1982

[54] PREFABRICATED BUILDING

[76] Inventors: Floyd E. Bigelow, Jr.; Floyd E. Bigelow, III; William H. Bigelow, all of P.O. Box 7064, Houston, Tex. 77008

[21] Appl. No.: 76,983

[22] Filed: Sep. 20, 1979

[51] Int. Cl.[3] ..... B65D 85/00; E04H 1/02

[52] U.S. Cl. ..... 52/34; 52/79.1; 52/90; 52/143; 52/173 R; 52/220; 52/221; 206/321

[58] Field of Search ..... 52/90, 143, 173 R, 643, 52/27, 79.1, 220, 221, 34; 206/321, 386

[56] References Cited

U.S. PATENT DOCUMENTS

| | | | |
|---|---|---|---|
| Re. 25,827 | 8/1965 | Bigelow, Jr. | 52/143 X |
| 2,131,124 | 9/1938 | Smith | 52/34 |
| 2,168,725 | 8/1939 | Whelan | 52/220 X |
| 2,332,059 | 10/1943 | Cheshier | 52/643 |
| 2,365,579 | 12/1944 | Mulligan | 52/90 |
| 2,419,319 | 4/1947 | Lankton | 52/220 X |
| 2,712,164 | 7/1955 | Sheffield | 52/34 X |
| 2,904,849 | 9/1959 | Bergstrom | 52/143 X |
| 3,680,273 | 8/1972 | Bigelow, Jr. | 52/143 |
| 3,694,973 | 10/1972 | Unger | 52/220 X |
| 3,792,558 | 2/1974 | Berce | 52/143 X |
| 4,165,591 | 8/1979 | Fitzgibbon | 52/90 |

*Primary Examiner*—Alfred C. Perham
*Attorney, Agent, or Firm*—Vinson & Elkins

[57] ABSTRACT

A prefabricated building in which utilities are provided for in a core unit in which ceilings are provided by prefabricated panels and in which the panels are tied to roof trusses.

3 Claims, 19 Drawing Figures

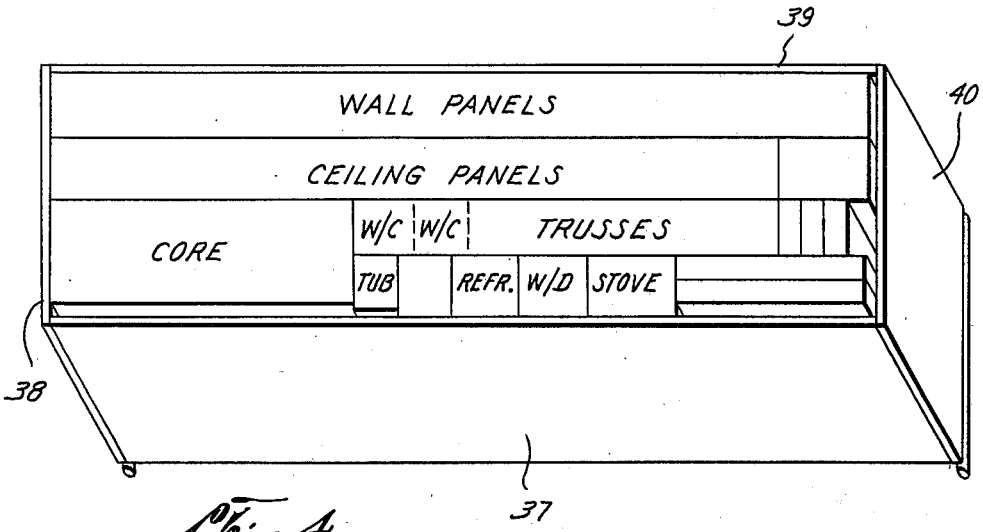
Fig. 4
Fig. 5
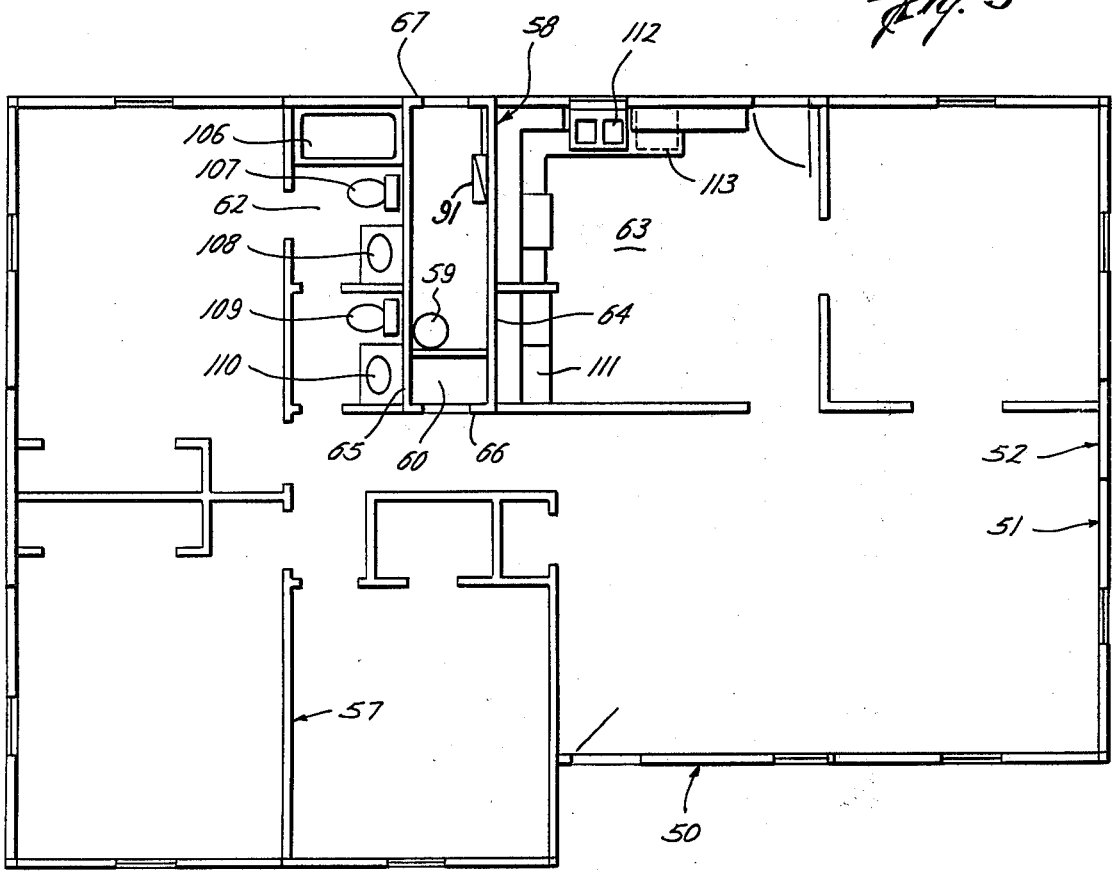

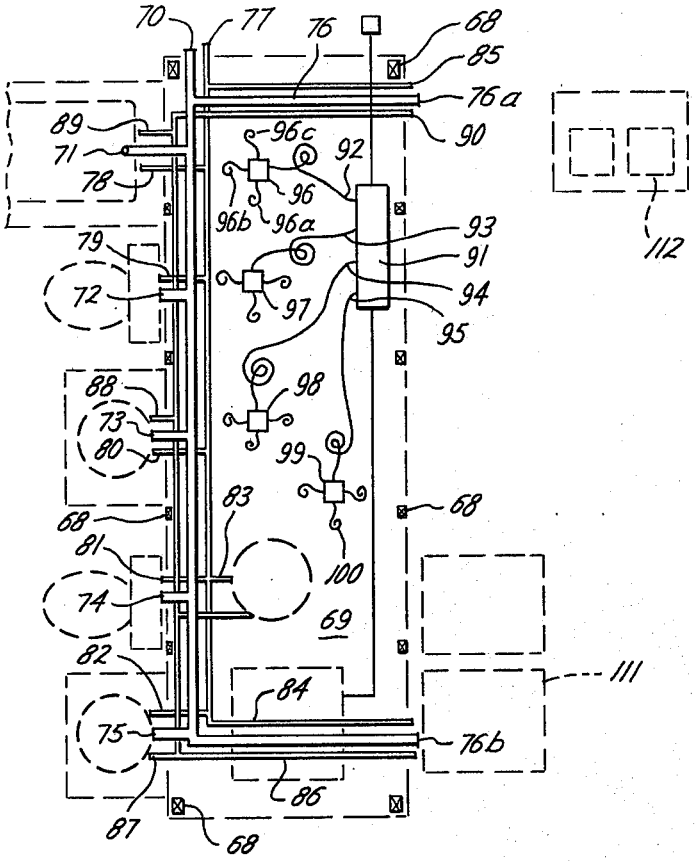
Fig. 10
Fig. 11
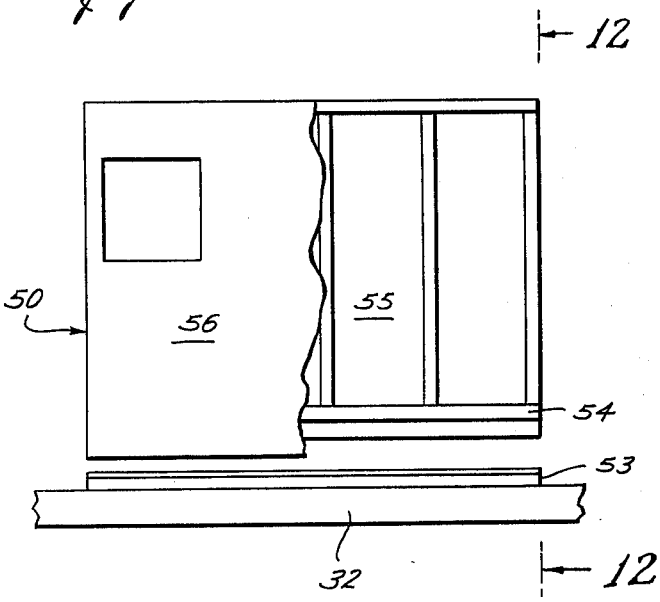
Fig. 12
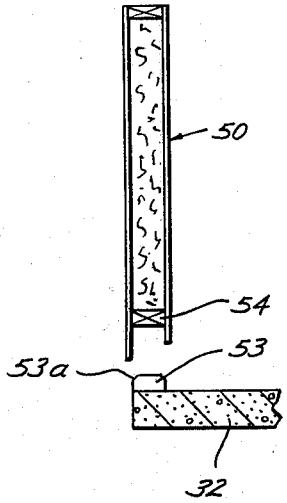

PREFABRICATED BUILDING

This invention relates to prefabricated buildings.

An object of this invention is to provide a combination shipping package and prefabricated building in which the shipping package is usable as a room, garage, or other facility after it has been unpacked and the prefabricated building removed from the shipping package.

Another object is to provide for a prefabricated building a core unit having the necessary conduits to provide water and sewage connections to bathroom, kitchen and utility fixtures located in rooms adjacent to the core unit.

A further object is to provide a core unit as in the preceding object in which a hot water heater and/or air conditioning units can be provided in the core unit.

Another object is to provide a core unit having the main sewage and water lines therein for connecting to bath and kitchen and utility type appliances in rooms adjacent to the core and in which an electrical breaker box is located which has connected thereto a plurality of electrical conduits which are in turn connected to junction boxes which carry electrical leads to be connected to electrical switches, outlets, etc., in the prefabricated building during its erection.

Another object is to provide a prefabricated building utilizing prefabricated ceiling panels.

Another object is to provide a prefabricated building utilizing ceiling panels in which the ceiling panels may be readily attached to roof trusses and to each other.

Another object is to provide trusses with suitable notches for reinforcing strips to mark for the assembling crew the proper location of the strips to provide the desired strength for the roof.

Another object is to provide a prefabricated building in which there is no penetration of the slab by plumbing or prelocation of plumbing.

Another object is to provide a prefabricated building in which the plumbing need not penetrate the floor system.

Other objects, features and advantages of the invention will be apparent from the drawings, the specification and the claims.

In the drawings wherein like numerals indicate like parts, and wherein an illustrative embodiment of this invention is shown;

FIG. 3 is a schematic exploded view of the shipping box showing the roof and one end wall removed for ready access to the box to remove the component parts of the prefabricated building and with parts of the outer sheeting of the box broken away to show framing within the box for doors, garage doors or the like;

FIG. 4 is a schematic view of the shipping box with top removed and indicating the areas of the box in which various portions of the prefabricated building may be shipped;

FIG. 5 is a plan view of the prefabricated building;

FIG. 10 is a schematic plan of the core showing the water, sewage and electrical system with bathroom and kitchen fixtures in dashed lines in the rooms adjacent to the core;

FIG. 11 is an exploded view of the slab and wall of the prefabricated building illustrating the manner in which a lower plate is attached to the slab and provides a guide for the wall section;

FIG. 12 is a view along the lines 12—12 of FIG. 11;

Figure 1:
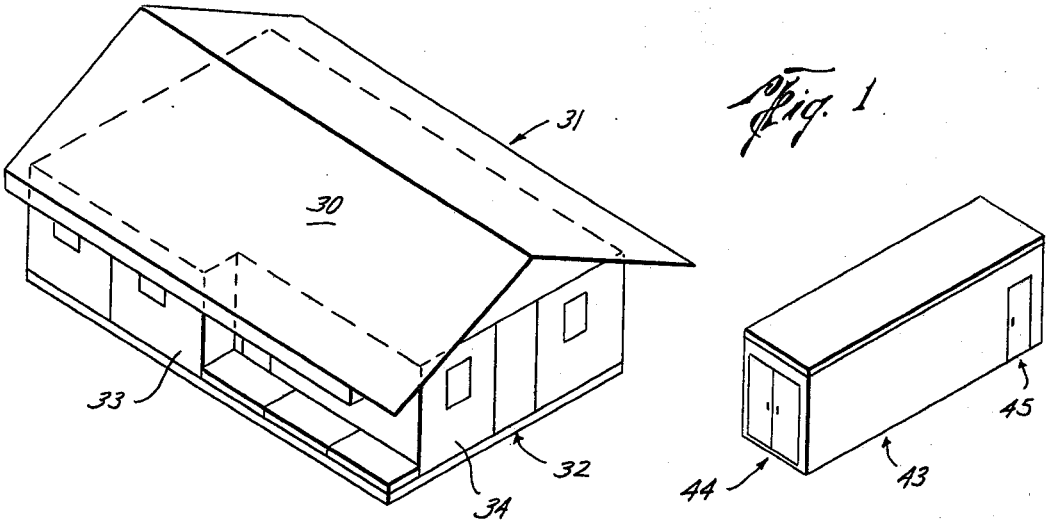
FIG. 1 is a schematic illustration of a prefabricated building erected in accordance with this invention with the associated shipping package shown being utilized as a garage and storage facility associated with the building.

The prefabricated building is shown in its assembled form at 31 in FIG. 1. The building may be built upon a conventional concrete slab or floor panels may be utilized as a floor for the building. If floor panels are utilized, they are preferably set on grade beams and would be constructed in similar manner to be ceiling panels which will be discussed hereinafter.

Figure 6:
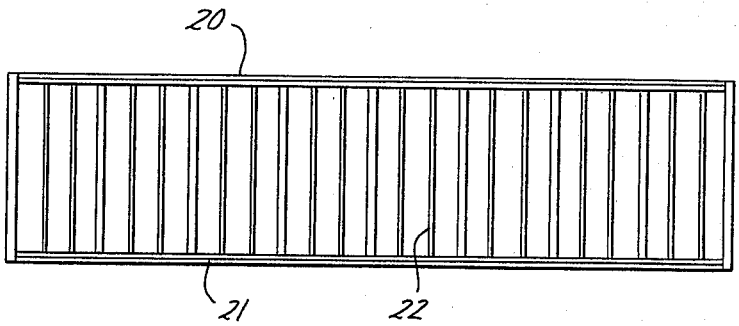
FIG. 6 is a plan view of a floor panel.
Figure 7:
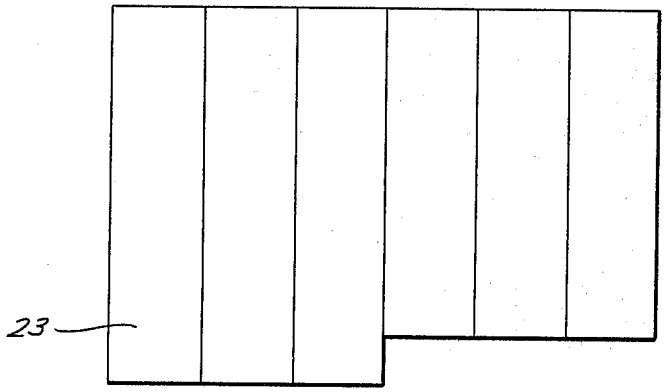
FIG. 7 is a floor panel plan for the entire building.
Figure 8:
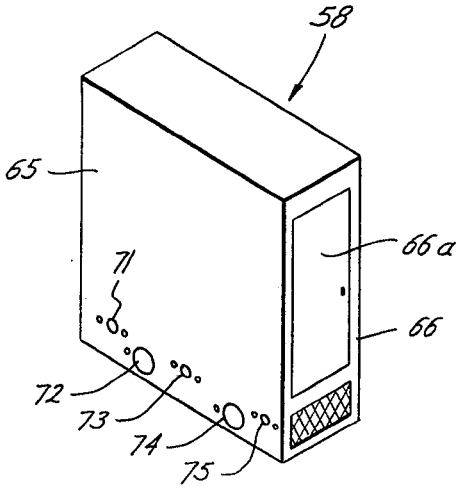
FIG. 8 is a schematic view taken from one side of the utility core.
Figure 9:
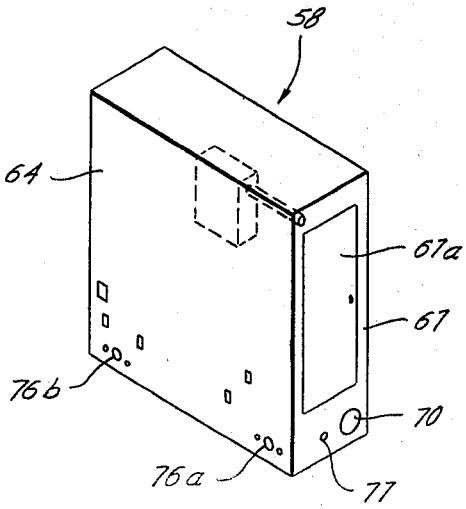
FIG. 9 is a schematic view taken from the other side of the core shown in FIG. 8.

Floor panels are shown in FIGS. 6 and 7. The panels include purlins 20 and 21 connected by joints 22, a suitable upper surface of plywood 23 provides the floor of the building.

The building illustrated in FIG. 1 is built on the slab indicated generally at 32. The building includes side walls 33, one of which is shown, and end walls 34, one of which is shown, and roof 30. From the exterior the building appears to be conventional in form and resembles a built in place building.

Figure 2:
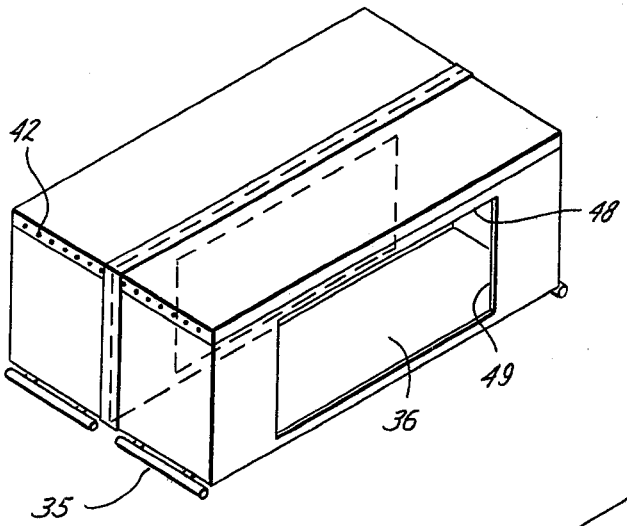
FIG. 2 is a schematic view of two of such storage boxes being erected to provide a large room.
Figure 3:
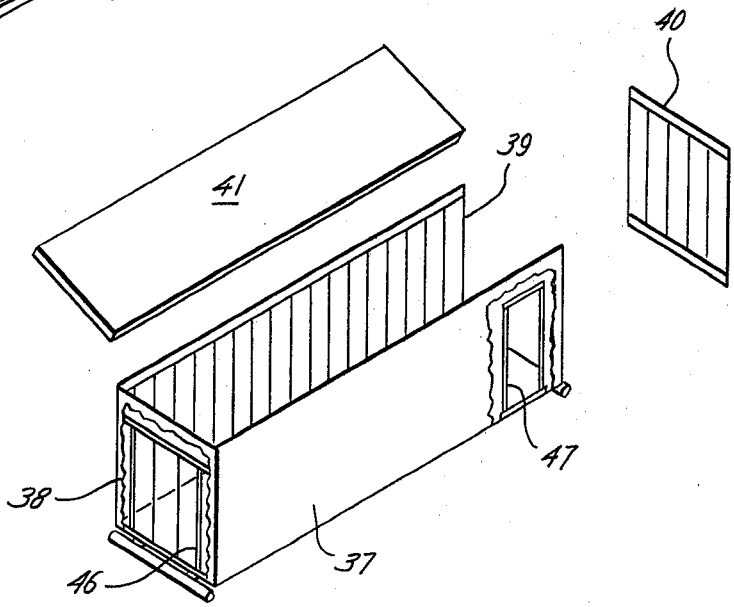

In its preassembled form the building is packed in a packing module. This module is shown in FIGS. 2, 3 and 4. The module includes a skid, the end of which is shown at 35, which is conventional in form and made up of side beams extending under the building and suitable cross-members such as shown in U.S. Pat. No. Re. 25,827 to F. E. Bigelow, Jr. The disclosure of this patent is incorporated herein in its entirety by reference, and the building or shipping module shown in FIGS. 2, 3 and 4 may be built in accordance with the teaching of this patent, or in accordance with the teaching of U.S. Pat. No. 3,680,273, the disclosure of which is incorporated herein in its entirety. The construction of the latter patent is preferred as it permits modules to be positioned close together as shown in said patent and in FIG. 2 hereof. In either case the shipping module includes the floor 36 which is built directly on the skid and the side and end walls 37, 38, 39 and 40, as well as the roof 41.

The construction permits the roof 41 to be lifted vertically upward from the building after it is released from the side walls. Where the teaching of the '273 patent is followed, suitable bolts such as shown at 42 in FIG. 2 extend through the downwardly depending skirt of the roof into the side wall. By removal of these bolts the roof is released from the side walls and may be picked vertically up and moved into an out of the way position in the conventional manner. The walls 37, 38 and 39 are attached directly to the floor in permanent manner. One end wall such as end wall 40 is removably secured to the floor and side walls. Thus, after the roof has been set aside the end wall 40 is also set aside and the contents of the shipping module are readily accessible.

The prefabricated building of FIG. 1 is packed within the shipping module as shown in FIG. 4 with the several components such as wall panels, ceiling panels, core, trusses, roof, trim, etc., all within the shipping module. Preferably also, the conventional fixtures such as normally found in a bathroom and kitchen are included, that is, tub, commodes, air conditioner, stove, and the like.

After the component parts of the prefabricated building 31 have been removed from the shipping module, the module may be utilized in conjunction with the prefabricated building or with other shipping modules, or individually in any desired form. For instance, in FIG. 1 the shipping module is shown at 43 to have been converted into a garage with garage doors indicated generally at 44, and a side entrance door indicated generally at 45. If it is intended to use the shipping module in this manner, the garage door can be preframed as indicated at 46 in FIG. 3. In like manner a side entrance door, windows or the like can be preframed, as indicated at 47 in FIG. 3. In any event the shipping module, when it leaves the factory, has a solid impermeable skin of material overlying the exterior of each of the walls of the shipping module so that it is a solid structure. This protects the interior of the shipping module from pilfering and from weather. After the shipping module has been unloaded, it is a simple matter to cut away the outer skin of material at the preframed section, such as 46 and 47, and to remove any studs or the like which might be within these preframed sections to readily permit the installation of doors, windows or the like.

As an alternative two or more of the shipping modules may be assembled together as taught in the above identified U.S. Pat. No. 3,680,273. In this use of the shipping module it is preferable to leave three or four feet of each side wall 37 and 39 which is to adjoin another building and to extend between these side walls a header 48. The internal space between two adjacent walls may be bridged in any manner desired, such as by vertical structural members such as two by eights 49, which can be secured to the walls and support header 48. The roofs are preferably secured together in the manner taught in the U.S. Pat. No. 3,680,273.

A sample floor plan of the prefabricated building is shown in FIG. 5. The building includes wall sections 50, 51, and 52, and like other wall sections extending about the perimeter of the house. When the wall sections are erected directly upon a concrete slab, a lower plate 53 (FIG. 12) is secured to the slab under each wall section. This lower plate may be beveled as at 53*a* and the wall sections, such as 50, has a recessed plate 54 such that the wall can be lowered onto the lower plate 53 and the recessed plate 54 will act as the upper of a double plate to support the wall. The inner and outer skin surface 55 and 56 of the wall will position the wall in place over the plate member 53. Suitable attachments of the wall to the lower plate 53 may be utilized, such as nails, screws, or the like, to secure the wall to the plate.

When floor panels are used it is preferred to secure the lower plate 53 to the panels. If desired, the exterior walls may have the lower plate 53 in the wall to provide a double plate. In this system the exterior skin of the wall would be secured to the floor panels instead of the lower plate. It will also be apparent that this relationship of a lower plate 53 and the wall may readily be used with the internal walls to both position and maintain the internal walls in place.

Both the perimeter walls of which sections 50, 51 and 52 form a part and the internal walls, such as internal wall 57, may be secured to each other in any desired manner, as by nailing or by nailing ties between wall sections.

In accordance with this invention the building is provided with a utility core shown generally at 58. Preferably, plumbing, including both water and sewage, are provided in this core, together with the conventional water heater 59. Space is provided at 60 for an airconditioning unit to provide for heating and cooling of the building. As an alternative the airconditioning unit may be positioned outside and in this event duct work would be run through the exterior wall of the core and then up through the ceiling of the core to a distribution plenum. Return air would be provided in the lower portion of the space 60. Electrical service is preferably provided through the breaker box 91 and as will appear hereinafter, the core will provide both sewage and water connections for the equipment shown in the bath 62 and the equipment shown in the kitchen 63.

The core is preferably rectangular and provided with two opposite side walls 64 and 65 as well as end walls 66 and 67. Each of the end walls 66 and 67 are provided with doors 66*a* and 67*a*. The door in the end wall 67 provides access to the core and the door in the end wall 66 provides access to the airconditioning unit. In accordance with conventional construction, the airconditioning unit is positioned a slight distance above the floor and a grill is provided in the end wall 66 for return air to the airconditioning unit.

Referring now to FIG. 10, the core is shown schematically with the walls represented by studs 68. The core has therein the floor 69 and the floor and walls of the core support the utilities for the unit. The line 70 represents the main sewer pipe which may be several inches in diameter. Extending from the sewer pipe at least into the wall or slightly beyond the side walls 64 and 65 are lateral sewer pipes 71 to the tub, 72 to a water closet, 73 to a wash basin, 74 to another water closet, and 75 to another wash basin. A lateral sewer line 76 has an inlet 76*a* for the kitchen sink and dishwasher, and a lateral 76*b* for a clothes washer.

Any desired equipment may be provided for by appropriate sewage connections arranged around the wall of the core.

In order to provide water for the building the water line 77 extends through the core and has branch lines 78, 79, 80, 81, 82, and 83 to the tub, water closets, wash basins and water heater. Other branch lines 84 and 85 provide water for the clothes washer and for the kitchen sink.

From the water heater the hot water line 86 has branches 87, 88, 89 and 90 going to the tub, water basin, kitchen sink and washing machine.

To avoid the back up of sewage into the tub, the tub may be elevated slightly. As an alternative the sewage outlet from the tub may go through the wall of the house and join the sewage line outside of the wall of the house to avoid back up of sewage into the tub.

Further in accordance with this invention, the core has provided therein and preferably secured to one wall thereof, the electrical breaker box 91 in which suitable fuses or reset breakers are provided. From the breaker box a plurality of conduits 92, 93, 94 and 95 extend to junction boxes 96, 97, 98 and 99, respectively. The lengths of the electrical conduits are sufficient to permit these conduits to be unrolled and position the several breaker boxes at strategic locations in the ceiling of the unit. Extending from these several breaker boxes are conduits, such as conduit 100, which are dimensioned to reach wall switches, lights, receptacles and the like, which are installed in the ceiling and the several walls of the building. These receptacles may be preinstalled or they may be installed at the time that the wires are strung. While the conduits leading from the breaker box and the several junction boxes and the conduits leading therefrom may be separately packed and separately installed, it is preferred that the junction boxes be connected to the leads from the junction boxes and all be stored in the core in preconnected condition so that it is only necessary to take the several junction boxes up through the ceiling of the core and to their desired locations in the ceiling panels of the building and then extend the several wires and switches, lights, etc., to the walls and ceiling.

After the several walls of the building have been erected around the core 58 the tub 106, the water closet 107, the basin 108, the water closet 109, the basin 110, the clothes washer 111, the sink 112 and the dishwasher 113 can be connected into the sewer and water conduits in the core 58 (FIG. 5).

Figure 19:
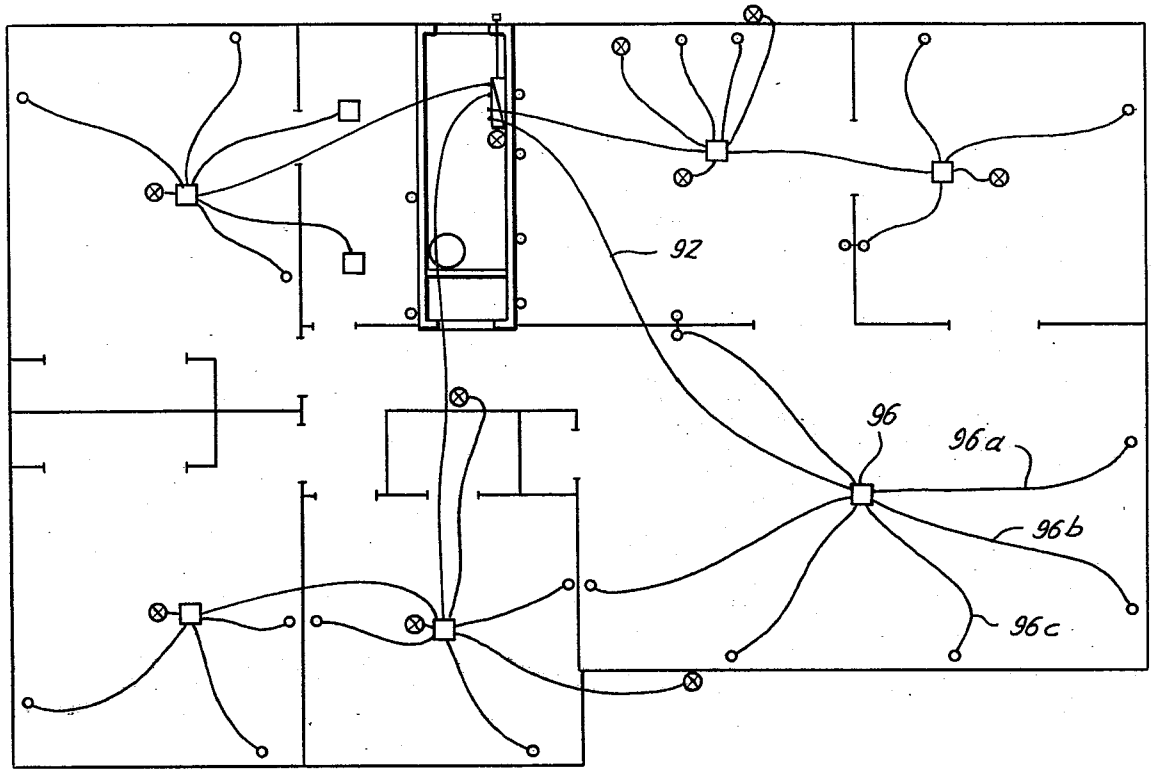
FIG. 19 is a view showing the electrical plan of the building.

FIG. 19 shows the manner in which the electrical conduits and junction boxes are extended after the walls have been erected and the ceiling is in place. For instance, conduit 92 might extend from the breaker box to the junction box 96 and the several conduits 96*a*, 96*b* and 96*c* may extend to switches, wall receptacles, ceiling lights and the like. It will be noted from FIG. 19 that it is preferred to provide a junction box for each main area of the building. For heavy load equipment, such as kitchen appliances, it is preferred that no junction box be used but that the conduits extend directly from reset breakers in the breaker box to the heavy equipment, or at most that a few pieces of heavy equipment be tied to a reset breaker.

Figure 14:
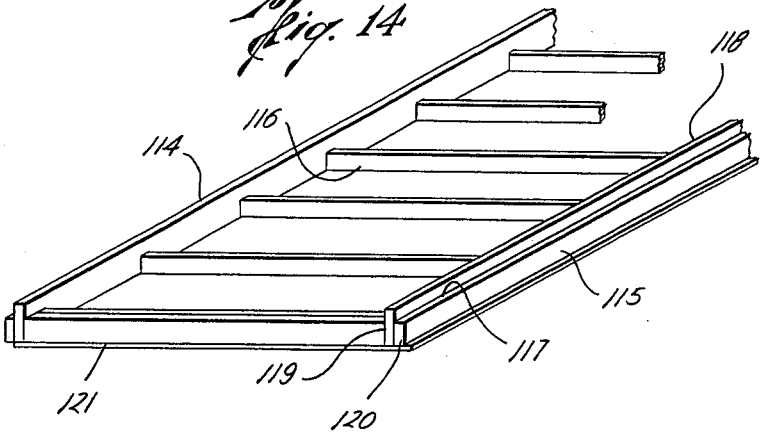
FIG. 14 is an isometric view of the ceiling panel.
Figure 13:
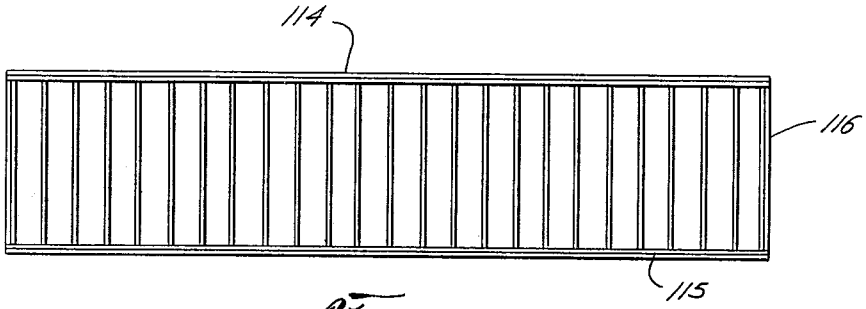
FIG. 13 is a plan view of a ceiling panel framing.
Figure 15:
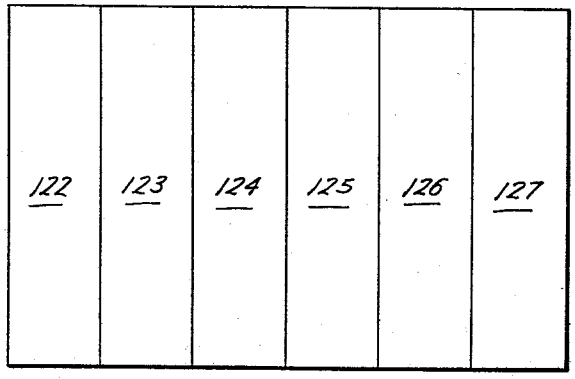
FIG. 15 is a ceiling panel plan.

In accordance with this invention ceiling panels may extend from perimeter wall to opposite perimeter wall or may be supported on an internal wall. The ceiling panels are shown in FIGS. 13, 14 and 15. Each ceiling panel includes parallel purlins 114 and 115 joined by a plurality of spaced joists 116. Each purlins includes an upwardly facing step configuration with a lower step 117 and an upper step 118. This may be provided by utilizing an inner two by six 119 placed on end with an outer two by four 120, also placed on end. The reason for this stepped configuration will be explained hereinafter in conjunction with the ceiling trusses.

Preferably, the ceiling panels extend the depth of the building and are of a convenient width such as eight feet. Thus, six of the ceiling panels will provide for a building forty-eight feet wide and the ceiling panels may be, for instance, thirty-two feet long to provide a building having a depth of thirty-two feet. Preferably the underside of the ceiling panels are finished with a ceiling material 121 which may be sheetrock, plastic panels, or the like. Thus, when several of the ceiling panels, such as the ceiling panels, 122, 123, 124, 125, 126 and 127 of FIG. 15, are positioned over the walls of the building in abutting relationship, they will provide a complete in place ceiling for the building. It is further preferred that there be in place in the ceilings on top of the ceiling material 121 suitable insulation material, such as batt insulation stapled in place during construction of the ceiling panel.

Figure 16:
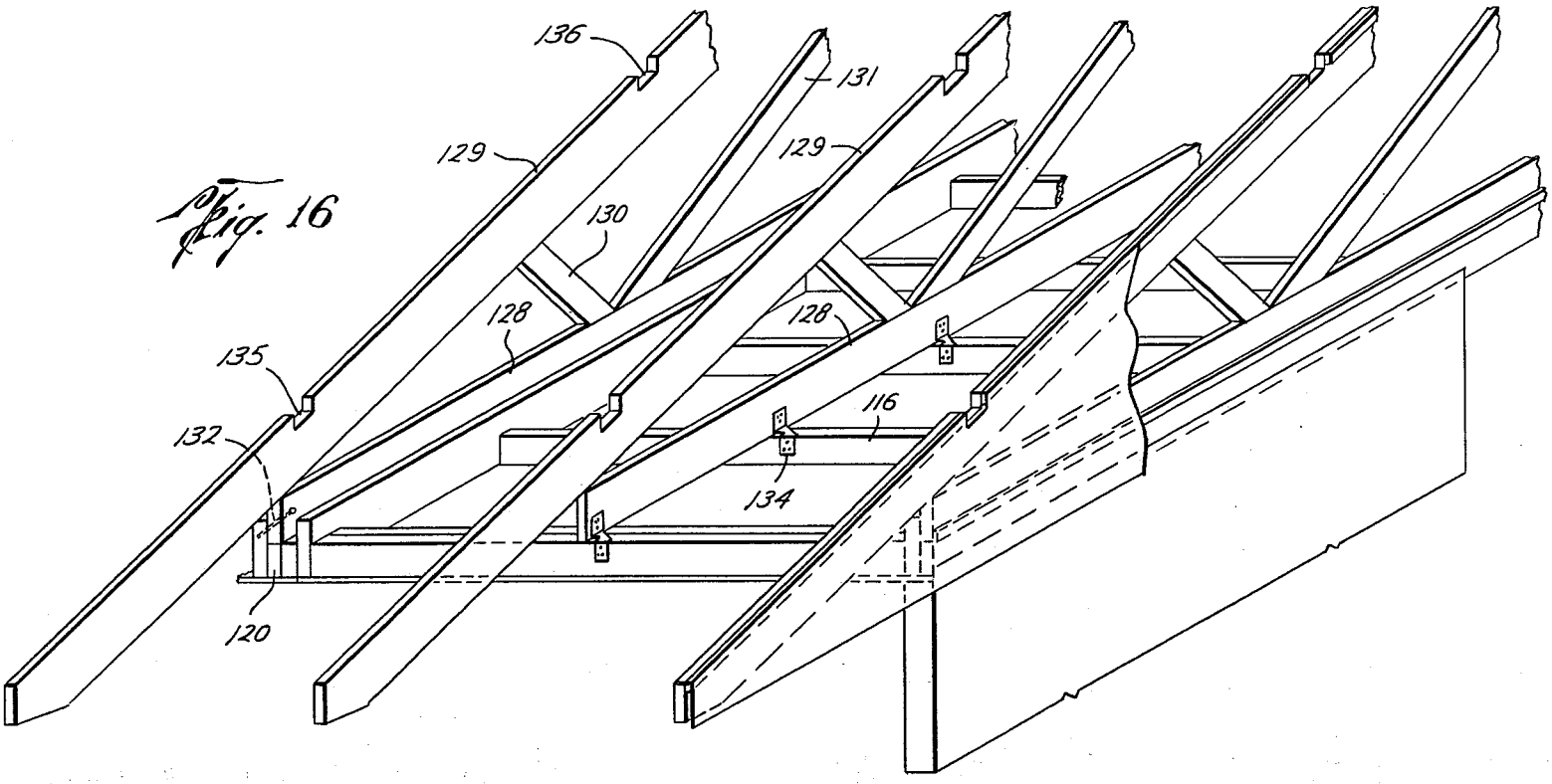
FIG. 16 is an isometric view of a section of the roof.

After these ceiling panels are all in place the roof trusses shown in FIG. 16 may be positioned on the ceiling. Preferably, the trusses are on four foot centers and therefore a truss will be located in the vicinity of each purlins of the ceiling panels and an additional truss will be located in between spaced purlins (see FIG. 18). The trusses include the lower chords 128 and upper chords 129 secured together by suitable struts 130 and 131. Either a full truss extending the full depth of the building may be used or two half trusses may be used and tied together if desired after the trusses have been erected on the roof.

Figure 17:
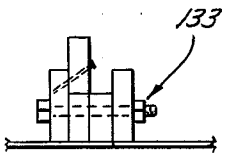
FIG. 17 is a fragmentary view showing attachment of ceiling panels together and to the roof truss.

The stepped configuration of the purlins permits the trusses to be positioned with the lower chord 128 of the trusses resting upon the two by four 120 providing the outer portion of purlins 114 and 115. Suitable nails 132 or other fasteners may be conveniently used to tie the lower chord 128 of every other truss to the purlins of the ceiling panel. Also, preferably, adjacent ceiling panels are tied together by suitable bolts and nuts indicated generally at 133 (see FIG. 17). The ceiling panels should be tied together at spaced intervals along the length of adjacent purlins and the lower chord of the trusses tied to one of two adjacent purlins as shown in FIG. 17, so that the trusses provide direct support for the ceiling panels. Additional support may be provided by tying brackets 134 between the lower chord of trusses intermediate the ceiling panel purlins and the ceiling joints 116 (see FIG. 16).

Figure 18:
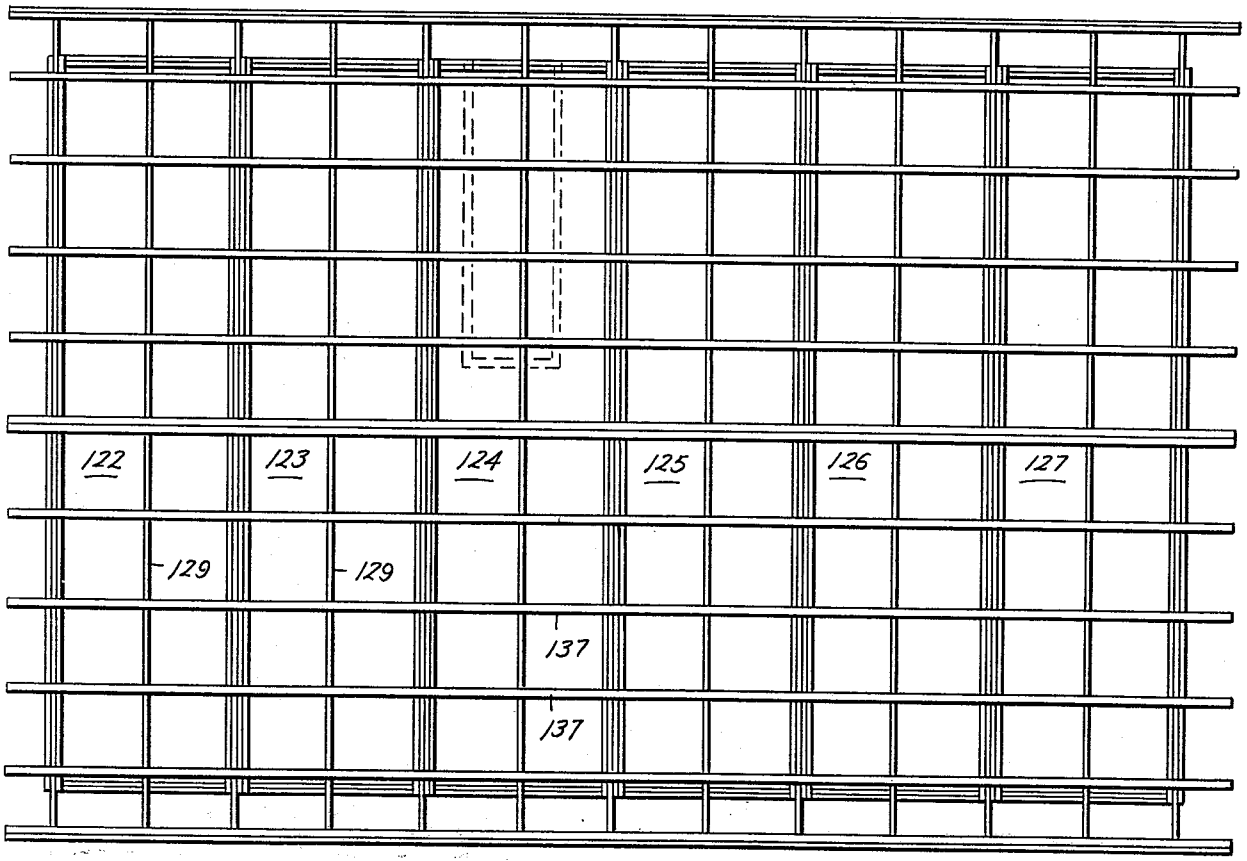
FIG. 18 is a plan view showing the ceiling panel and truss location.

The upper chords 129 should be tied to each other by appropriate strip material, such as two by fours, to provide adequate strength for the roof. To insure that when the building is assembled these two by four strips will be in the proper place the upper chords are notched as at 135 and 136. This will insure that workmen place the strips in the proper position to provide adequate strength for the roof. These tying strips are shown in FIG. 18 at 137. In addition to providing strength the strips provide support and an attachment point for roofing material such as metal strips or a plywood base for shingles or the like.

The complete building, including all walls, trusses, panels, etc., can be packed in the shipping module. Thus, parts are not lost or misdirected in shipping and theft during shipping is prevented or minimized by the solid module, increasing greatly the probability of the entire building reaching the erection site.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A prefabricated building comprising:

a plurality of exterior and interior wall sections joined together in a selected configuration;

a plurality of ceiling panels extending between said walls;

a plurality of roof trusses overlying said ceiling panels;

a roof supported by said trusses;

a utility core comprising:

a plurality of vertical connected core walls extending vertically, one of said core walls providing an exterior wall of said building, an access door in said one wall, a main sewer line supported in said core and extending through said one core wall and having a plurality of lateral sewer lines extending through said core walls, a main water line extending through said one core wall and supported in said core and having a plurality of lateral water lines extending through said core walls, a water heater in said core connected to said main water line, a main hot water line connected to said heater and having a plurality of lateral hot water lines extending through said core walls, a breaker box in said core, a plurality of electrical conduits extending from said breaker box, said core prefabricated prior to erection of said building; and fixtures utilizing water and discharging sewage connected to selected one of said lateral lines.

2. The building of claim 1 wherein, said ceiling panels have parallel purlins interconnected by spaced joists, said joists have an upwardly facing two-step configuration with the lower step outboard of the joists, said trusses have top and bottom chords interconnected by struts, the low chords of said trusses abutting said first step of said purlins, and means securing said lower chords to said purlins between said steps.

3. A prefabricated house kit and shipping box therefor:

a rectangular shipping box comprising:

a skid, a floor permanently attached to said skid, three walls permanently attached to said floor, a fourth wall removably attached to said floor and two of said three walls, a roof removably attached to said walls, said walls being without doors or windows or other openings to provide a pilfer proof box, said fourth wall and roof being re-attachable to said floor and walls to provide a usable building; and prefabricated building components comprising:

a plurality of exterior and interior wall sections adapted to be joined together in a selected configuration, a plurality of ceiling panels adapted to extend between said walls, a plurality of roof trusses adapted to overlie said ceiling panels, a roof adapted to be supported by said trusses; and a utility core comprising:

a plurality of vertically connected core walls extending vertically, one of said core walls adapted to provide an exterior wall of a building, an access door in said one wall, a main sewer line supported in said core and extending through said one core wall and having a plurality of lateral sewer lines extending through said core walls, a main water line extending through said one core wall and supported in said core and having a plurality of lateral water lines extending through said core walls, a water heater in said core connected to said main water line, a main hot water line connected to said heater and having a plurality of lateral hot water lines extending through said core walls, a breaker box in said core, a plurality of electrical conduits extending from said breaker box; and fixtures utilizing water and discharging sewage adapted to be connected to selected ones of said lateral lines, all of said building components being packed in said shipping box and when removed therefrom and erected providing a building.

* * * * *